US007364104B2

(12) United States Patent
Chojnacki

(10) Patent No.: US 7,364,104 B2
(45) Date of Patent: Apr. 29, 2008

(54) CUTTING MACHINE FOR ORGANIC PLANT MATERIALS, ESPECIALLY FOR TOBACCO

(75) Inventor: Jerzy W. Chojnacki, Radom (PL)

(73) Assignee: International Tobacco Machinery Poland Ltd., Radom (PL)

( * ) Notice: Subject to any disclaimer, the term of this patent is extended or adjusted under 35 U.S.C. 154(b) by 0 days.

(21) Appl. No.: 10/536,527

(22) PCT Filed: Dec. 12, 2003

(86) PCT No.: PCT/PL03/00143

§ 371 (c)(1),
(2), (4) Date: Aug. 12, 2005

(87) PCT Pub. No.: WO2004/052127

PCT Pub. Date: Jun. 24, 2004

(65) Prior Publication Data

US 2006/0097094 A1 May 11, 2006

(30) Foreign Application Priority Data

Dec. 12, 2002 (PL) ..... 357739

(51) Int. Cl.
*B02C 2/04* (2006.01)

(52) U.S. Cl. ..... 241/286; 241/277; 241/293

(58) Field of Classification Search ..... 241/286, 241/294, 242, 277, 293
See application file for complete search history.

(56) References Cited

U.S. PATENT DOCUMENTS

| | | | | |
|---|---|---|---|---|
| 2,751,949 | A * | 6/1956 | Ritscher | 241/192 |
| 2,763,307 | A * | 9/1956 | Schreiber | 241/101.2 |
| 2,819,746 | A * | 1/1958 | Baglioni | 241/101.2 |
| 2,829,694 | A * | 4/1958 | Jarvis | 241/227 |
| 4,085,494 | A * | 4/1978 | Sybertz et al. | 29/468 |
| 4,218,024 | A * | 8/1980 | Pallmann | 241/188.1 |
| 4,467,970 | A | 8/1984 | Sagemuller | |
| 4,619,413 | A * | 10/1986 | Wistuba | 241/222 |
| 4,632,318 | A * | 12/1986 | Hyuga | 241/37 |
| 6,634,579 | B2 * | 10/2003 | Drenguis | 241/30 |

FOREIGN PATENT DOCUMENTS

| | | |
|---|---|---|
| DE | 32 22 433 | 2/1983 |
| EP | 1 151 680 | 11/2001 |

* cited by examiner

*Primary Examiner*—Faye Francis
(74) *Attorney, Agent, or Firm*—Darby & Darby PC

(57) ABSTRACT

A cutting machine for organic plant materials has a frame in which a cutterhead of a drum having sets of cutting knives (16, 18) symmetrically arranged on its perimeter surface is mounted. At least two separate knife extension arrangement (10, 10*a*) are arranged opposite to each other within the drum and actuated separately by being connected to the corresponding cutting knives (16, 18) through a motor (1, 1*a*) whose speed is controlled by an external signal independent of speed of the cutterhead drum.

5 Claims, 4 Drawing Sheets

CUTTING MACHINE FOR ORGANIC PLANT MATERIALS, ESPECIALLY FOR TOBACCO

Figure 1:
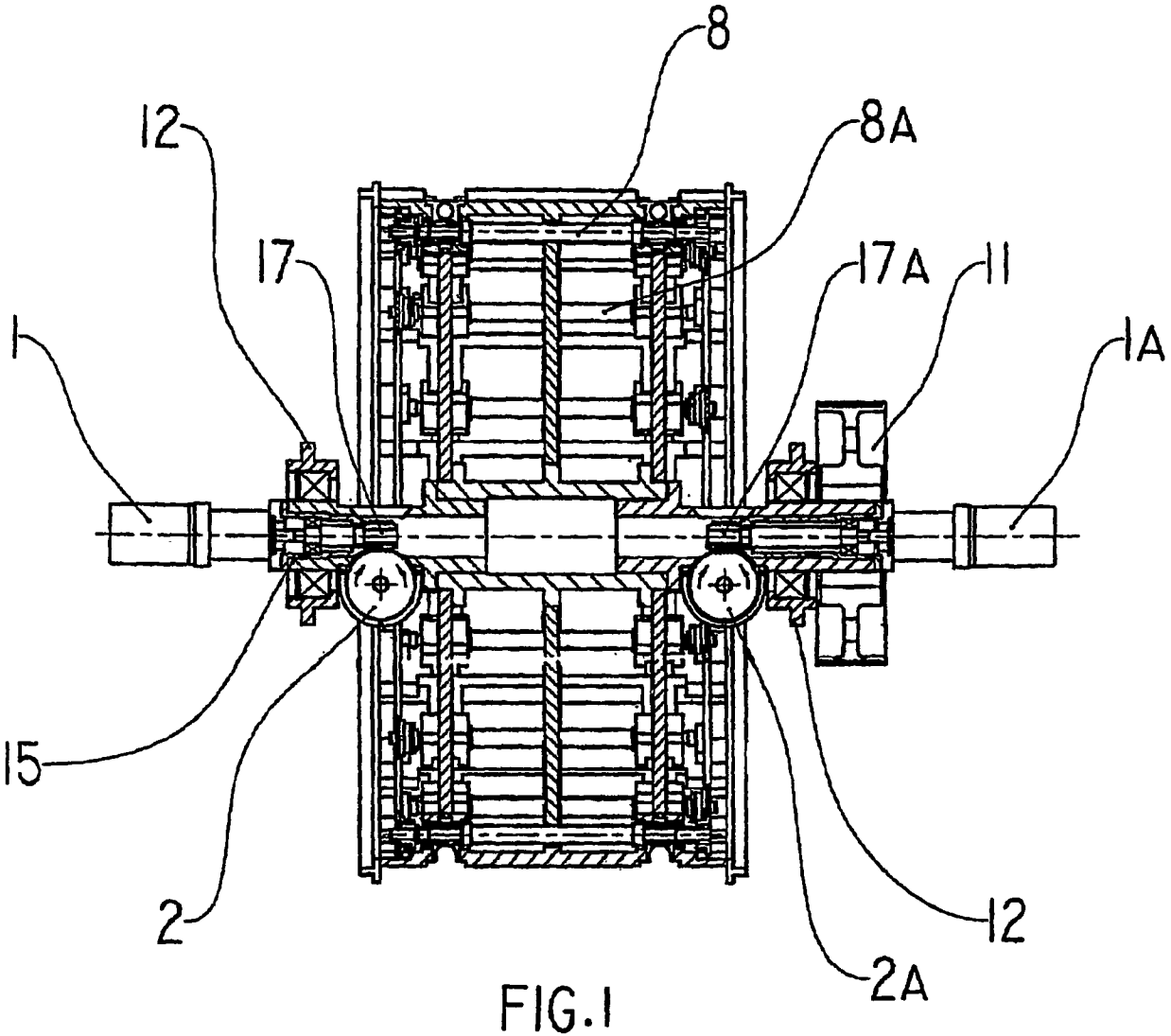

This invention relates to a cutting machine for organic plant materials, especially for tobacco.

A cutting machine of this type is known from the Polish patent application Pl347 304 as well as from patent applications U.S. Pat. No. 4,364,402 and U.S. Pat. No. 4,467,970, EP 584 524, GB 2 105 578, DE 3 127 697 and 3 222 433, the machine comprising a frame and a cutterhead mounted in the frame, the cutterhead being in the form of a drum having cutting knives symmetrically arranged on its perimeter surface, the cutterhead being arranged on a drive shaft driven by a belt transmission, the shaft being coupled by a coupling mechanism with the main worm gear which is connected, by means of an articulated shaft and a conical gear, to a driving wheel, the wheel, by means of a driving chain, driving chain wheels mounted on knife extension rollers, the rollers directly driving the knife extension arrangement through another subsequent worm gear.

However, operation of these known cutting machines is based on the registration of the torque of the main cutterhead drum drive, on which extension of the knives is dependent (mechanical gear).

According to the invention, the cutting machine for organic plant materials, especially for tobacco, comprising a frame and a cutterhead mounted in the frame, the cutterhead being in the form of a drum having cutting knives symmetrically arranged on its perimeter surface, the cutterhead being arranged on a drive shaft driven by a belt transmission, the shaft being coupled by a coupling mechanism with the main worm gear which is connected, by means of an articulated shaft and a conical gear, to a driving wheel, the wheel, by means of a driving chain, driving chain wheels mounted on knife extension rollers, the rollers directly driving the knife extension arrangement through another subsequent worm gear, is characterised in that the cutterhead comprises two separate knife extension arrangements arranged alternately to each other below the perimeter surface of the cutterhead drum and actuated separately, preferably by two separate slidable coupling subassemblies co-operating with corresponding two main worm gears arranged on both sides of the cutterhead, each of the two knife extension arrangements being connected to the corresponding cutting knives and equipped with a separate electric driving mechanism comprising an electric motor, revolutions of which being controlled by means of an external signal independent of parameters of the cutterhead drum motion, the signal being transmitted and adjusted by electric motors by means of an electric signal specifying the required extension rate of the appropriate knives set, the motors being arranged axially symmetrically on both sides of the drive shaft.

Preferably, the cutting knives are grouped into two separate functional sets of the cutting knives, linked with the corresponding knife extension arrangements by means of two driving chains placed on both sides of the cutterhead drum, the successive cutting knives in these two functional sets being arranged alternately to each other along the perimeter surface of the cutterhead above the corresponding knife extension arrangement, and, moreover, each of the functional sets comprises $2^{|n|}$ single cutting knives, where $|n|$ denotes the absolute value of an integer.

Figure 2:
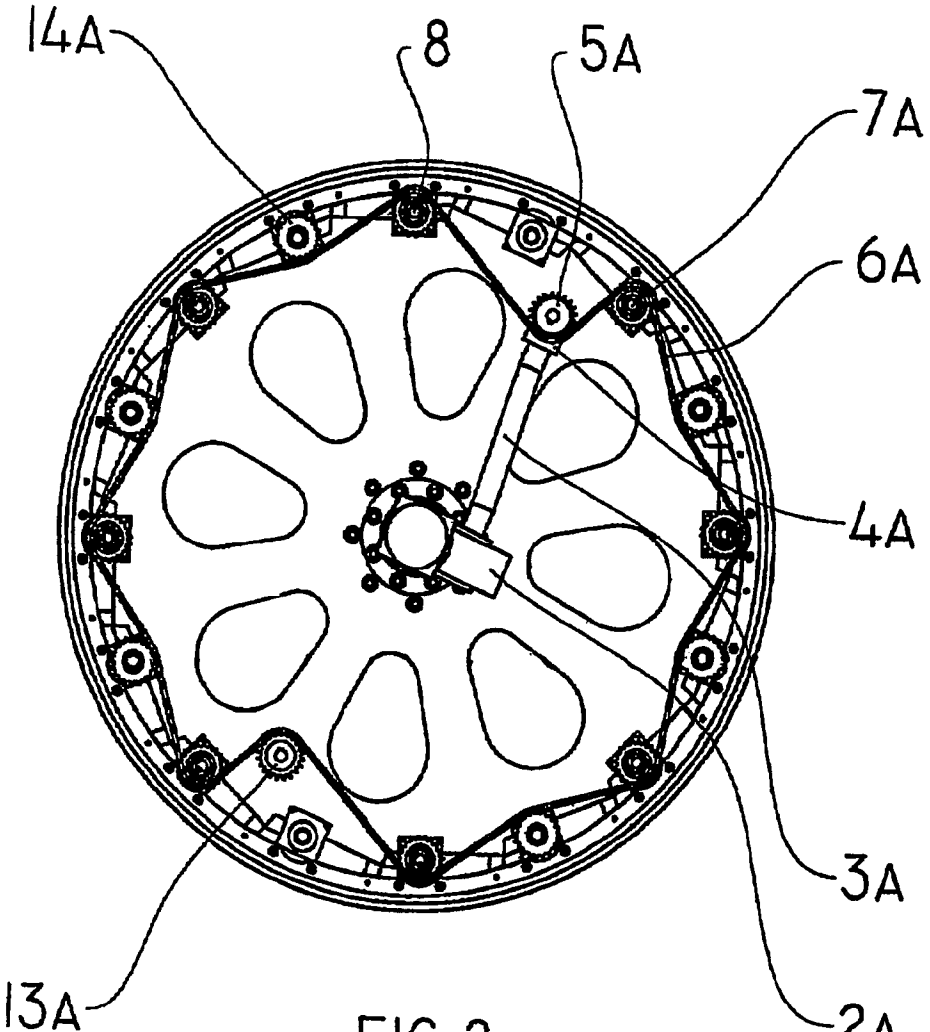
Figure 3:
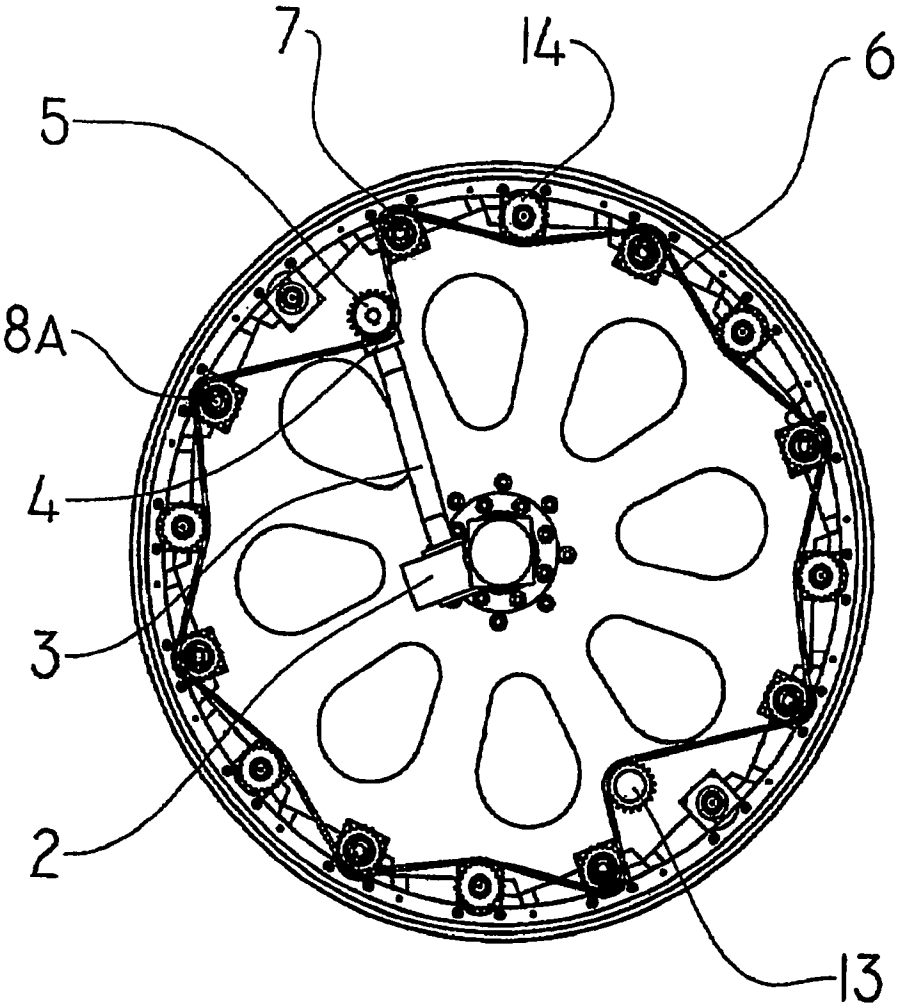
Figure 4:
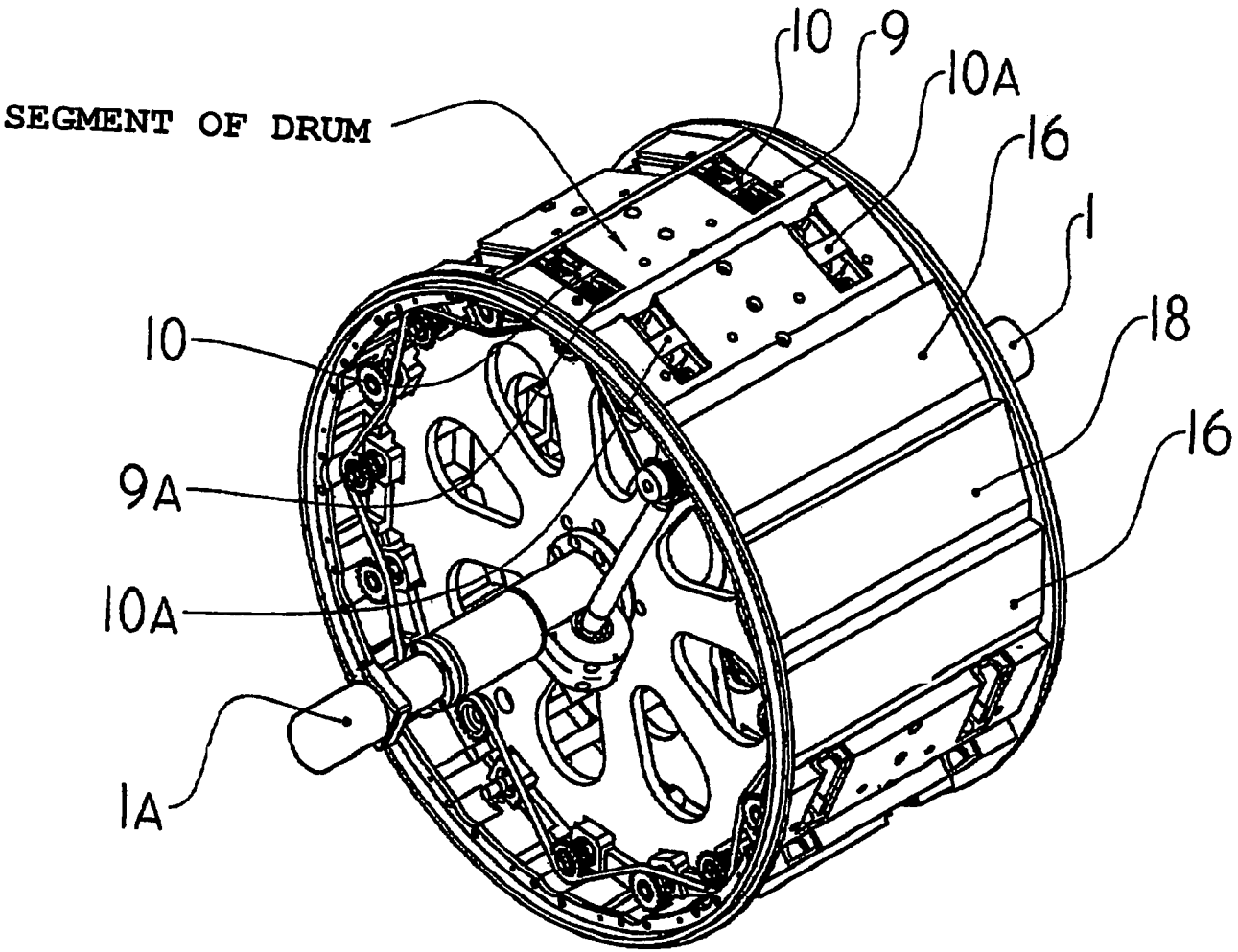

The invention is illustrated by the embodiment shown in the accompanying drawing, in which:

FIG. 1 shows a cross-sectional view through the cutterhead of the cutting machine according to the invention, FIG. 2 shows a side view seen from one side of the cutterhead of the cutting machine according to the invention, FIG. 3 shows a side view seen from second side of the cutterhead of the cutting machine according to the invention, FIG. 4 shows a perspective view of the cutterhead of the cutting machine according to the invention.

FIG. 1 shows a cross-section through the cutterhead of the cutting machine according to the invention, mounted on the main drive shaft 15 placed within the frame 12 and driven through the driving wheel 11. Stepping motors 1, 1*a* are located on the main shaft 15 symmetrically on both sides of the cutterhead, the motors being separately controlled and being provided for separate driving each of the knife extension arrangements, 10, 10*a*, placed symmetrically on both sides of the cutterhead. The torque required for extension of the knife 16, 18 is transmitted from the electric motors 1, 1*a* through the worm gears 2, 2*a*. FIGS. 2 and 3 show views of the cutterhead from both sides, illustrating the double-sided transmission of power from the worm gears 2, 2*a* through the articulated shafts 3, 3*a* and the conical gears 4, 4*a* to the driving chain wheels 5, 5*a* which, by means of the driving chains 6, 6*a*, drive the chain wheels 7, 7*a* directly driving the knife extension rollers 8, 8*a*, which are shown also in FIG. 1. Tensioning chain wheels 13, 13*a* are used to optimise tension parameters including the wrapping angle of the driving chains 6, 6*a*, situated as shown in FIG. 2, as well as chain wheels arrangements increasing the wrapping 14, 14*a*. It is to be noted that the driving chain wheels 7*a* are slid over onto the extension rollers 8 from one side of the cutterhead drum and the chain wheels arrangements 14 increasing the wrapping are slid over from the other side, whereas the driving chain wheels 7 are slid over onto the extension rollers 8*a* from one side of the cutterhead drum and the chain wheels arrangements 14*a* increasing the wrapping are slid over thereon from the other side. As shown in FIG. 4, cutting knives 16, 18 are arranged on the perimeter of the rotary cutterhead drum.

FIG. 4 shows the worm gears 9, 9*a* located on the extension rollers 8, 8*a*, the worm gears driving directly the both separate screw knife extension arrangements 10, 10*a*. The illustrated embodiment enables separate extension and separate control of extension parameters of the both knives sets 16, 18, maximum 8 knives in each, coupled with the corresponding knife extension arrangement 10, 10*a*. As already described above, the cutterhead of the cutting machine according to the invention comprises two separate knife extension arrangements 10, 10*a* placed alternately to each other below the perimeter surface of the cutterhead drum. The two separate knife extension arrangements 10, 10*a* are separately actuated by means of two separate slidable coupling subassemblies 17, 17*a* located on both sides of the cutterhead drum, co-operating with the two corresponding main worm gears 2, 2*a* placed on both sides of the cutterhead. The first separate knife extension arrangement 10 is connected to the cutting knives 16 and the second separate knife extension arrangement 10*a* is connected to the cutting knives 18. Both arrangements 10, 10*a* are equipped with separate driving mechanisms comprising electric motors 1, 1*a* having revolutions controlled by means of an electric signal specifying the required rate of extension of the appropriate knives set. The electric motors are arranged axially symmetrically on both sides of the drive shaft 15.

The knives 16, 18 are grouped into two separate functional sets of cutting knives coupled to the corresponding knife extension arrangements 10, 10*a* by means of two driving chains 6, 6*a* located on both sides of the cutterhead drum. The successive cutting knives 16, 18 in these functional sets are placed alternately to each other along the perimeter surface of the cutterhead, above the corresponding knife extension arrangement 10, 10*a*. Each of the separate functional sets of the cutting knives preferably comprises $2^{|n|}$ single cutting knives 16, 18, where |n| denotes the absolute value of an integer.

Preferably, the cutting knives are grouped and extended during operation according to the following series: 16 or 8 or 4 or 2 or 1. The series satisfies the general formula: $2^{|n|}$, where n is an integer. The illustrated embodiment, in which 8 knives are used, enables operation of the cutting machine in three operational modes of the worm gear 2 or 2*a*, the modes being selected by appropriate operational coupling of the selected one or two worm gears 2, 2*a* by shifting the coupling subassembly 17, 17*a*.

At most 8 cutting knives of the knife extension arrangement 10 are extended (active) in the first mode, the second set of at most 8 cutting knives of the knife extension arrangement 10*a* being not extended and being left in the waiting (stand-by) mode.

The second set of at most 8 cutting knives of the knife extension arrangement 10*a* are extended in the second mode, the previous set of at most 8 cutting knives of the knife extension arrangement 10 being retracted to the waiting (stand-by) position and being left not extended (inactive).

Both sets of at most 8 cutting knives of both knife extension arrangements 10, 10*a* are extended so that the number of extended (active) knives on the perimeter satisfies the condition of the above mentioned series.

Each set of the cutting knives 16, 18 comprise its separate driving mechanism, which is driven by the electric motor 1, 1*a*. Digital control of operational parameters of such motor enables precise, unequivocal and reliable coupling one or both the knife extension arrangements 10, 10*a* so that the cutting edges of the active knives sets 16 and/or 18 are located at the precisely defined surface of a cylinder required by the device's operational parameters, the axis of rotation of the cylinder being the same as the axis of the cutterhead, and the extension rate of all the active knives 16 and/or 18 being the same.

When the active (the first one) cutting knives set 16 are extended by the knife extension arrangement 10, the second cutting knives set 18 are in the inactive waiting mode and the cutting knives 18 are not extended. If the active cutting knives set 16 happen to be damaged and/or need to be replaced, then the solution of the invention enables automatic retraction of the active cutting knives set 16 to the inactive position and automatic extension (activation) of the second cutting knives set 18. Also possible is simultaneous activation of both cutting knives sets 16, 18. The above operations may also be carried out manually.

The illustrated cutting machine enables precise and independent of the rotational speed of the cutting machine drum extension of at least one set 16, 18 of knives cutting the tobacco material, the knives being arranged on the perimeter of the rotary cutterhead drum, both for cutting the tobacco material as well as for cleaning and sharpening the knives 16, 18 after an operation cycle.

The invention claimed is:

1. A cutting machine comprising:

a drum on a rotatable drive shaft to be driven by a motor;

a plurality of cutting knives spaced around the perimeter of said drum; and a knife extension apparatus for extending and retracting each of said plurality of cutting knives relative to the periphery of said drum, wherein the cutting knives are grouped into at least two separate functional sets of the cutting knives, each set linked with a corresponding knife extension apparatus by means of a respective driving chain placed on each side of the drum, the cutting knives in each of said functional sets being arranged alternately to each other along the perimeter surface of the drum above the corresponding knife extension apparatus, and, wherein each separate functional cutting knife set comprise $2^{|n|}$ single cutting knives, where |n| is an integer number.

2. A cutting machine as claimed in claim 1 further comprising a motor separate from the motor that rotates the drum for driving said knife extension apparatus.

3. A cutting machine comprising:

a drum on a rotatable drive shaft to be driven by a motor;

a plurality of cutting knives spaced around the perimeter of said drum;

a knife extension apparatus for extending and retracting each of said plurality of cutting knives relative to the periphery of said drum, wherein said knife extension apparatus comprises:

a motor at each end of said drive shaft that drives a corresponding worm gear;

a drive chain at each end of said plurality of cutting knives looped over the corresponding end of each of said plurality of cutting knives; and drive coupling apparatus between said worm gear associated with each said motor and a corresponding drive chain to rotate the corresponding drive chain in opposite directions to extend and retract each said cutting knife.

4. A cutting machine as claimed in claim 3 wherein said drive coupling apparatus further comprises a shaft having a gear at one end that meshes with a corresponding motor worm gear and a gear at the other end that engages the corresponding drive chain.

5. A cutting machine as claimed in claim 3 wherein said drive shaft has a hollow part on opposite outer sides of said drum; and a stub drive shaft for each said motor extending within a said hollow part of said drive shaft, each said stub shaft having one end driven by a corresponding drive motor and a gear at the other end to mesh with the corresponding worm gear.

* * * * *